US006886814B1

(12) United States Patent
Schuld

(10) Patent No.: US 6,886,814 B1
(45) Date of Patent: May 3, 2005

(54) ADAPTABLE EVAPORATIVE ELEMENT FOR A HUMIDIFIER

(76) Inventor: Daniel E. Schuld, 1776 Prestwick, Inverness, IL (US) 60067

( * ) Notice: Subject to any disclaimer, the term of this patent is extended or adjusted under 35 U.S.C. 154(b) by 0 days.

(21) Appl. No.: 10/405,197

(22) Filed: Apr. 2, 2003

Related U.S. Application Data

(63) Continuation-in-part of application No. 09/781,870, filed on Feb. 12, 2001, now Pat. No. 6,568,662.

(51) Int. Cl.[7] ..... B01F 3/04

(52) U.S. Cl. ..... 261/94; 261/100; 261/106; 261/107; 428/136

(58) Field of Search ..... 261/94, 99, 100, 261/103, 104, 106, 107; 55/529, DIG. 5, DIG. 31; 96/294, 296; 428/135, 136

(56) References Cited

U.S. PATENT DOCUMENTS

| | | | | |
|---|---|---|---|---|
| 2,175,903 | A | 10/1939 | Lichtman | 55/DIG. 31 |
| 2,637,540 | A | 5/1953 | Rowe | 261/94 |
| 2,955,064 | A | 10/1960 | Frohmader | 154/46 |
| 3,092,442 | A | 6/1963 | Shoemaker | 21/53 |
| 3,155,560 | A | 11/1964 | Onstad et al. | 156/222 |
| 3,242,562 | A | 3/1966 | Kraft | 55/DIG. 5 |
| D243,335 | S | 2/1977 | Trombley | D23/146 |
| D243,336 | S | 2/1977 | Painter | D23/146 |
| 4,014,796 | A | 3/1977 | Sugiyama et al. | 55/DIG. 31 |
| 4,042,358 | A | 8/1977 | Frohmader | 55/497 |
| 4,117,045 | A | 9/1978 | Henke et al. | 261/30 |
| 4,151,095 | A | 4/1979 | Wright | 55/DIG. 5 |
| 4,251,583 | A | 2/1981 | Donachiue | 261/107 |
| 4,338,266 | A | 7/1982 | Flower | 261/94 |
| 4,504,290 | A | 3/1985 | Pontius | 55/316 |
| 4,701,196 | A | 10/1987 | Delany | 55/481 |
| 4,746,432 | A | 5/1988 | Taki et al. | 55/529 |
| 4,839,086 | A | 6/1989 | Zaid | 252/182.3 |
| 5,037,583 | A | 8/1991 | Hand | 261/26 |
| 5,087,276 | A | 2/1992 | Snyder | 55/DIG. 31 |
| 5,110,511 | A | 5/1992 | Hand | 261/104 |
| 5,133,904 | A | 7/1992 | Pepper | 261/24 |
| 5,145,500 | A | 9/1992 | Nolen, Jr. | 55/DIG. 31 |
| 5,188,646 | A | 2/1993 | Nolen, Jr. | 55/DIG. 31 |
| D337,634 | S | 7/1993 | Copland et al. | D23/356 |
| 5,250,232 | A | 10/1993 | Pepper et al. | 261/24 |
| 5,374,381 | A | 12/1994 | Schuld et al. | 261/106 |
| 5,476,526 | A | 12/1995 | Attermeyer | 55/DIG. 31 |
| D374,480 | S | 10/1996 | Micoley | D23/356 |
| D376,419 | S | 12/1996 | Seaman et al. | D23/356 |
| 5,681,630 | A | 10/1997 | Smick et al. | 55/529 |
| 5,807,415 | A | 9/1998 | Leo | 55/529 |
| 6,007,596 | A | 12/1999 | Rosen | 55/DIG. 31 |
| 6,568,662 | B2 * | 5/2003 | Schuld | 261/94 |
| 6,684,445 | B1 * | 2/2004 | Rios et al. | 15/120.1 |
| 2003/0017300 | A1 * | 1/2003 | Clay | 428/100 |

FOREIGN PATENT DOCUMENTS

| | | |
|---|---|---|
| CA | 2044023 | 4/1992 |
| JP | 4-367703 | 12/1992 |
| JP | 5-103931 | 4/1993 |
| JP | 6-226024 | 8/1994 |

OTHER PUBLICATIONS

Coolpad Article.

* cited by examiner

*Primary Examiner*—Scott Bushey
(74) *Attorney, Agent, or Firm*—Greer, Burns & Crain, Ltd.

(57) ABSTRACT

An adaptable evaporative element for a humidifier or the like is described. The evaporative element having separable layers, such that the thickness of the evaporative element is adaptable by varying said evaporative element between a separated and an unseparated configuration. An alternate embodiment uses removable fasteners attachable to the ends of a cuttable strip of evaporative layers to form a circular evaporative element. The evaporative element is adaptable between an uncut and one of a plurality of cut configurations. The evaporative element optionally includes an air filter media attached to its exterior.

11 Claims, 6 Drawing Sheets

ADAPTABLE EVAPORATIVE ELEMENT FOR A HUMIDIFIER

CROSS REFERENCE TO RELATED APPLICATIONS

This application is a continuation-in-part of U.S. Ser. No. 09/781,870, filed Feb. 12, 2001, now U.S. Pat. No. 6,568,662 entitled ADAPTABLE EVAPORATIVE ELEMENT FOR A HUMIDIFIER and herein incorporated by reference.

BACKGROUND

The present invention relates to evaporative elements and filters for use in humidifiers, evaporative coolers and the like. The invention specifically relates to improved evaporative elements that are adaptable to fit multiple sizes of humidifiers.

For many years, humidifiers have been manufactured and sold having replaceable evaporative elements, also known as filter cartridges. The purpose of the evaporative element is to spread water over a large surface area to promote evaporation of the water into the air when air is directed over and through the element. The evaporative element may also perform a subsidiary function of filtering the air and/or water. It is well recognized in the art that it is desirable to have an element that has a large surface area. It is also well known to make the evaporative element from materials that promote capillary or wicking action to absorb and spread the water throughout the evaporative element. Coatings are known that aid water retention and distribution on nonporous surfaces. The evaporative element should be made of materials and with a configuration sufficient to maintain structural integrity of the evaporative element when it is subjected to prolonged use in water, heat and air flow circulation.

A large variety of humidifiers are marketed and sold, both commercially and to consumers, in a variety of shapes and sizes. Further, even after a particular model of humidifier is discontinued or modified, there is a market for replacement cartridges for that humidifier with owners of such units, who become frustrated if they are unable to find replacement cartridges when their humidifier is still in working condition. These factors combine to produce a large number of evaporative elements available for purchase, which retailers, such as hardware or home improvement stores, attempt to carry for the convenience of their customers. Retailers not only dedicate shelf space to this plethora of cartridges, but also generate a large number of SKUs, and the associated problems in inventory control, warehousing, shipping and distribution of the cartridges.

Further, the availability of so many different evaporative elements may be confusing to the consumer. Particular manufacturers often use cartridges of the same general shape, varying the dimensions only slightly. Recognizing the manufacturer's name, the consumer may purchase a cartridge that is similar to that needed for his humidifier, but later find that it does not fit properly.

Other consumers may purchase a cartridge that is too large for their unit, and then attempt to cut it to size using the old cartridge as a template. However, after normal aging and prolonged use in water, the evaporative elements may have swelled, begun to sag, or lost their original shape for other reasons. When the old cartridge is used as a template, the new one may not be cut to the correct size, and may not fit properly. Humidification efficiency may be lost if air is permitted to bypass the evaporative element without being exposed to the water thereon.

The need to reduce the number of evaporative elements available for humidifying appliances has resulted in universal cartridges that are adaptable to fit more than one humidifier. One such prior art device consists of a large cartridge made of materials that are cut to size by the consumer. Included with the cartridge is a sheet of paper with numerous lines indicating where the evaporative media is to be cut, to create a cartridge the correct size for the consumer's humidifier. The consumer then must hold the paper in place without it moving while cutting the evaporative elements. If the paper shifts during cutting, the cartridge may be ruined or may result in an imprecise fit in the humidifier by allowing air to bypass the evaporative element altogether. In the alternative, the consumer may choose to use a time-consuming, multi-step process of cutting the paper, marking the evaporative element, then cutting it.

Thus there is a need in the art for evaporative elements for humidifiers that fit more than one model so as to reduce the number of replacement parts that retailers must distribute, and yet provide a convenient means to the consumer of adapting the evaporative element.

SUMMARY OF THE INVENTION

These and other objects are met or exceeded by the present invention which features an evaporative element that fits humidifiers of more than one size. Use of such an evaporative element allows retailers to stock fewer different cartridges, and makes it less likely that the consumer will purchase an evaporative element that will not fit his humidifier.

More specifically, the invention relates to an adaptable evaporative element for a humidifier or the like. A first embodiment is a cylindrical evaporative element with a folded portion, such that the size of the evaporative element is adaptable by varying the evaporative element between a folded and an unfolded configuration. Preferably, it includes a plurality of prefolded, stacked layers of a water retaining media and at least one layer of a prefolded, perforated, substantially rigid, malleable material. The rigid layer is juxtaposed to at least one of the layers of water retaining media for supporting the layers, and for holding the stacked layers in either a prefolded or an unfolded configuration. An adhesive means is used for bonding the layers of media together and for bonding the rigid material layer to the water retaining media layers to form a laminated evaporative element. The size of the evaporative element is conveniently adapted by opening the fold to fit a humidifier requiring a larger evaporative media.

In an alternate embodiment, the evaporative element includes a first length of laminated evaporative media with a slit extending substantially the entire width and into the thickness of the evaporative media at a second length and having a separable portion from the second length to the first length, the slit being sufficiently deep that the separable portion is separable at the slit without the use of tools. Preferably, the evaporative element includes a plurality of stacked, perforated, layers of substantially rigid material with a water retaining coating on the exterior of said substantially rigid material. An adhesive means bonds the layers together, forming a laminated evaporative element. The slit extends sufficiently through the thickness of the evaporative element that it is adaptable from the first length to the second length along the slit without the use of tools. The size of said evaporative element is adaptable by breaking off the separable portion to create an evaporative element of a size smaller than when purchased.

A third embodiment of the invention includes a guide attached to the cuttable evaporative media, having a plurality of cutting lines indicative of a plurality of cut configurations. The size of the evaporative element is adaptable by varying the evaporative element between an uncut and one of a plurality of cut configurations. Preferably, the evaporative element includes a plurality of stacked layers of cuttable, water retaining media. An adhesive means bonds the layers together, forming a laminated evaporative element. As purchased, the guide is pre-attached to the evaporative element and is ready for cutting it to a selected configuration. Adhesion of the guide to the evaporative element allows cutting of the evaporative element and cutting guide in a single step, yet prevents the guide from slipping during the cutting process. The size of the evaporative element is thus adaptable by cutting the cutting guide and the evaporative element together to obtain one of the plurality of cut configurations.

In a fourth embodiment, a first plurality of stacked layers of water retaining media are bonded to each other to form a first laminated unit and a second plurality of stacked layers of water retaining media bonded to each other to form a second laminated unit. At least two layers of a perforated, substantially rigid material are separably bonded to each other and have the first laminated unit bonded to one exterior surface of the rigid material layer and the second laminated unit bonded to a second exterior surface of the rigid material layer. The thickness of the evaporative media is adaptable between a separated and an unseparated configuration by grasping the two rigid layers and gently pulling them apart.

A fifth embodiment includes a cylinder formed from a circumferential length of flexible, cuttable, laminated evaporative media with ends abutted to each other. The diameter of the cylinder is adaptable by selecting the circumferential length between a cut and an uncut configuration. At least one fastener is removably attachable to the evaporative media to secure the ends in the abutted position. An optional air filter media is attached to the outside of the evaporative media and removably attaches to the fasteners.

Each of these embodiments yields an evaporative element for two or more humidifiers for which it is most suitable as a replacement part. The resulting cartridges assist retailers in reducing the number of replacement cartridges that they must carry in stock in order to satisfy the needs of the consumers. This reduction also saves warehouse and shelf space, and limits the number of items and SKUs that must be tracked on inventories.

The cartridges of this invention are also convenient for the consumer. Use of the evaporative cartridges of the present invention permit adaptation of a cartridge to multiple sizes with little chance of error by cutting of a cartridge to the wrong size. In some cases, adaptation of the evaporative cartridge results in two of more elements of the approximate size for the user's humidifier. The number of steps required to generate the appropriate size evaporative element is reduced, in some cases to a single step.

Accordingly, the objects of the invention have been well satisfied. These advantages and others will become more fully apparent from the following detailed description when read in conjunction with the accompanying drawings.

DETAILED DESCRIPTION OF THE DRAWINGS

DETAILED DESCRIPTION OF THE INVENTION

Figure 1:
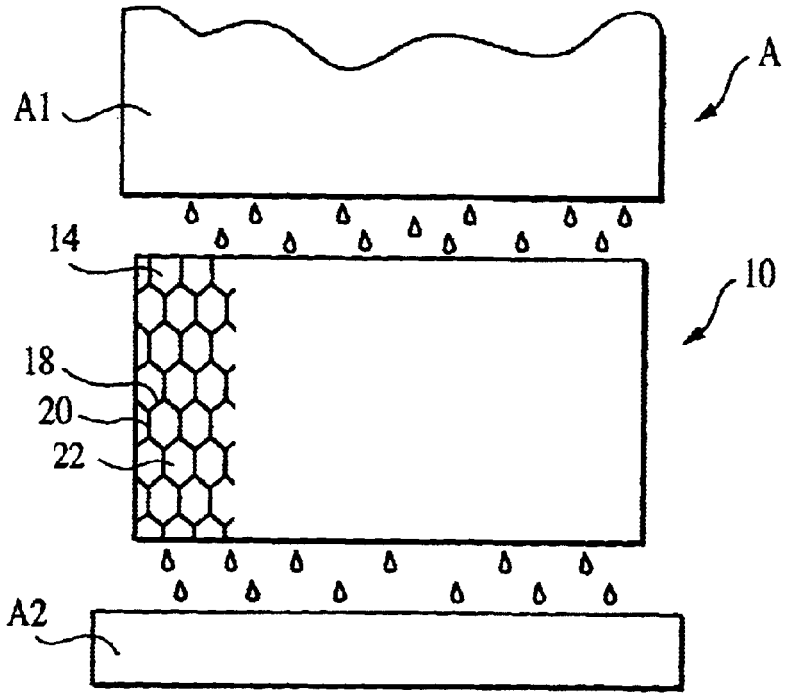
FIG. 1 is a schematic representation of a trickle down type humidifier.

Referring now to FIG. 1, the invention comprises an adaptable evaporative element, generally designated 10, for a humidifier, generally A, or the like. The humidifier A is shown diagrammatically as comprising a water source A1 and a water collection pan A2. Water is directed from source A1 through the evaporative element 10 and is collected for recirculation in pan A2. Air is preferably directed by a fan, blower or other means (not shown) through element 10 in a general direction normal to the surface of the drawing. The trickle down type of humidifier A is merely shown as one example of a use for the evaporative element 10 of the invention.

Alternatively, the evaporative element 10 of the invention may be used in other types of humidifiers, including, but not limited to wick-up types where the element is partially immersed in a water bath, or rotary types where the evaporative element is partially immersed in a bath and rotated. Additionally, the element 10 of the invention may be used in evaporative coolers.

Figure 2:
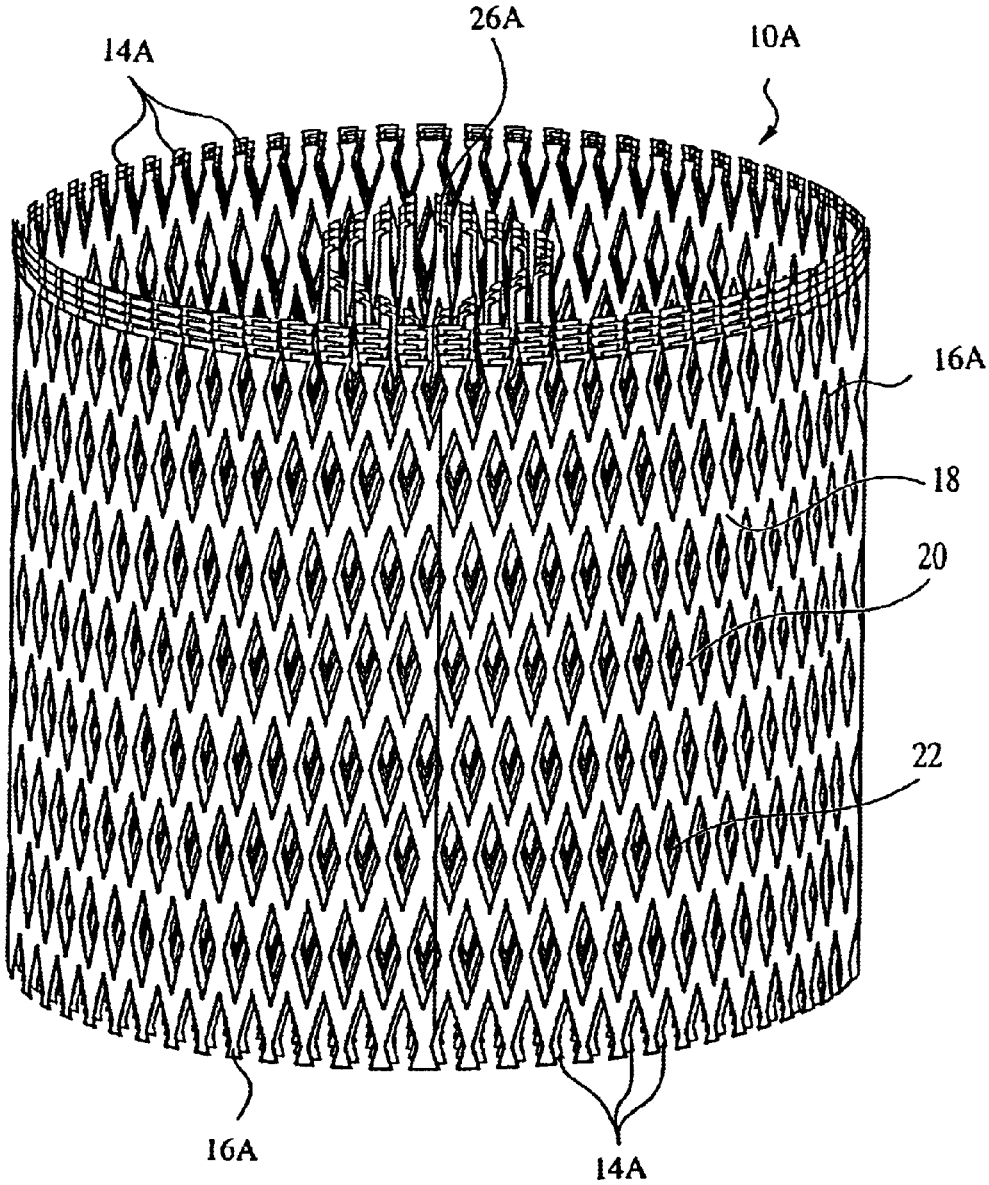
FIG. 2 is a perspective drawing of a first embodiment of the evaporative element of the present invention.

Generally referring to a first embodiment of the evaporative element, generally designated 10A, is shown in FIG. 2. It includes a plurality of stacked layers of a water retaining media 14A and at least one layer of a perforated, substantially rigid, malleable material 16A. Both the water retaining media 14A and the perforated, substantially rigid material 16A are preferably made of slit and expanded construction. This construction is known in the art for making evaporative elements for humidifiers, as taught in U.S. Pat. No. 5,374,381, wherein incorporated by reference.

Figure 3:
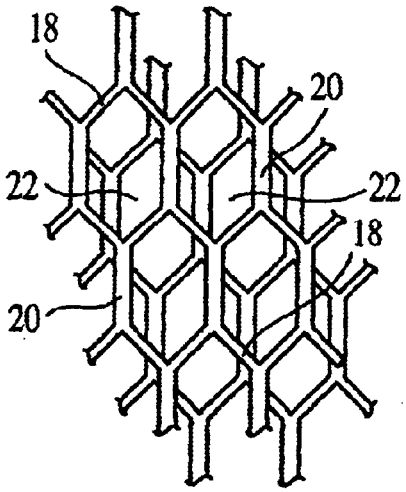
FIG. 3 is a detailed plan view of a portion of the evaporative element of FIG. 2.

When the materials are slit and expanded, shown best in FIG. 3, a lattice is formed of bridges 18 and strings 20 defining openings 22 therein. It is desirable to stagger the openings 22 in adjacent layers to expose a greater surface area of the materials to the air flow. Generally, the air flows normally to the layers shown, although on a small scale, the air chooses a tortuous path around the strings 20 and bridges 18 to find openings 22 at each layer. This flow pattern brings the air in contact with more water at the surface of the evaporative element 10. Conventional machinery for slitting and expanding materials is preferably used, resulting in an economical manufacturing process. For example, one effective slit and expanded material has slits ⅝ inches long at ¼ inch spacing, having bridges ⅛ inch in length, strings ¼ inch in length to produce openings 9/16×¼ inches.

Referring now to FIG. 2, a first embodiment 10A is shown where adaptation of size is accomplished by means of a fold 26A in the evaporative element 10A. The size of the evaporative element 10A is conveniently adaptable by varying the evaporative element between a folded and an unfolded configuration. The evaporative element 10A is made to an unfolded size designed to replace a large cartridge. Preferably during manufacture or packaging, the element 10A is pre-folded to conform to a smaller, different diameter replacement cartridge. The malleability of the substantially rigid material layer 16A serves to hold the evaporative element 10A in the chosen shape, whether it is folded or unfolded. Folding of the element 10A during the manufacturing or packaging stage holds it in the folded configuration, helps to set the crease and hold the folded shape. Adapting of the evaporative element from one size to a different size by merely straightening the fold 26A provides an easy and convenient method of varying the size of the replacement to fit more than one humidifier model. A cylindrical evaporative element was made according to this embodiment of the invention having a folded diameter 10¾ inches that expanded to an unfolded diameter of 12½ inches.

Figure 4:
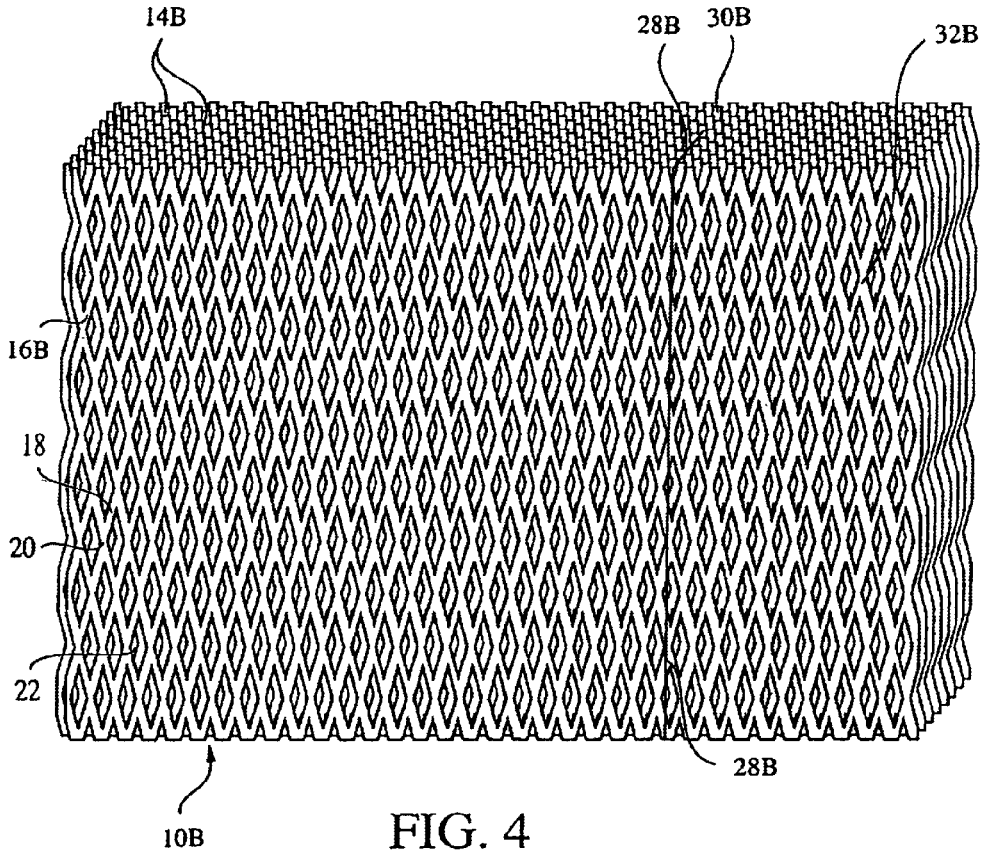
FIG. 4 is a perspective view of an alternative, second embodiment of the evaporative element of the invention.

Referring now to FIG. 4, a second embodiment of the evaporative element is generally designated 10B. Features shown in the second embodiment are identified with a suffix B, and like elements are given the like numerals. The size of the evaporative element 10B is adapted by means of a slit 28B that extends through a sufficient portion of the evaporative element to form a hinge 30B and a separable segment 32B that is easily detached without the use of tools. The slit 28B extends substantially the entire width of the evaporative element 10B at a second length that is smaller than the entire first length of the evaporative element as purchased. The evaporative element 10B is therefore adapted by bending the element at the hinge 30B and breaking off the separable segment 32B to create an evaporative element having a length equal to the second length. Separation of the separable segment 32B from the remaining evaporative element 10B is preferably as easy as applying a force on either side of the hinge 30B, tending to widen the slit 28B, and having the uncut layers break apart under the strain.

Choice of the water retaining media 14B, the rigid layer 16B and the optional coating will determine the separability of the components. The preferred materials, including both the water retaining media 14B and the rigid layer 16B, should be able to snap apart at the slit 28B under force applied by hand. If these materials are too soft, the evaporative element 10B may bend and flex too much to break apart easily. The evaporative element 10B may not bend or break at all if the water retaining media 14B and rigid layer 16B are too strong, and require the use of tools to separate the two portions. The coating that is optionally a part of the water absorbent media 14B, may also contribute to the ability of the evaporative element 10B and the separable segment 32B to break away from each other. For this reason, multiple layers of the aluminum foil, slit, expanded, and covered with a water retaining coating, is the most preferred water retaining media 14B for this embodiment 10B.

The materials from which the evaporative element 10B is fabricated also determine the depth of the slit 28B. Any depth is suitable as long as the evaporative element 10B holds together in the unadapted form, and the separable portion 32B breaks away when force is applied by hand. Preferably, the slit will extend about ½ to about ¾ of the thickness of the evaporative element 10B. An evaporative element made of eleven layers of slit and expanded metal had an overall depth of 1⅜inches, a one-inch slit was effective to create a separable portion for reducing a 10"×13" pad to a 10"×10" pad.

Figure 5:
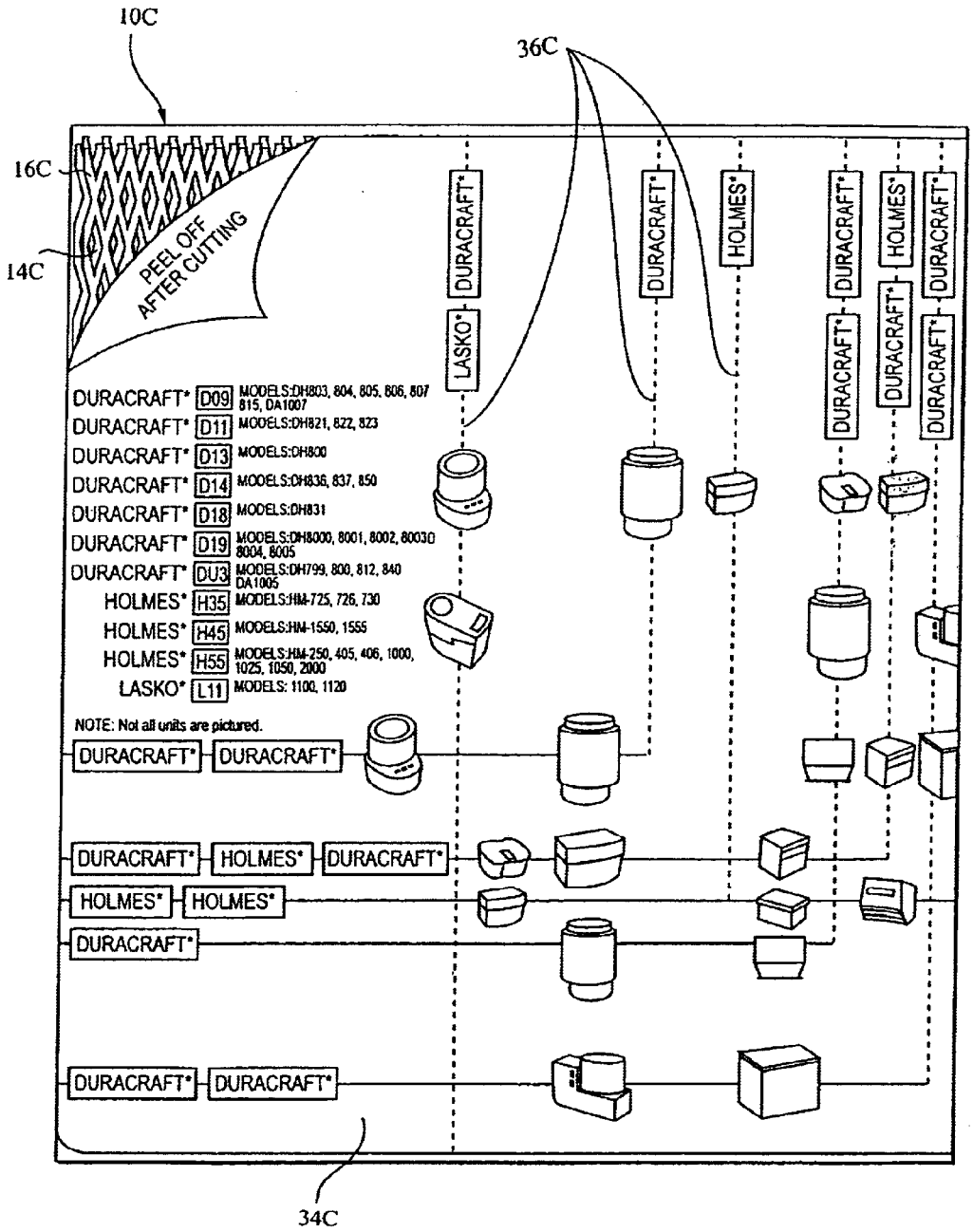
FIG. 5 is a top plan view of a third embodiment of the invention.

A third embodiment of this invention, generally designated 10C, is shown in FIG. 5. The features of this embodiment are identified with a suffix C, and like features are identified with like numerals. The evaporative element 10C includes a guide 34C attached to the evaporative element 10C for cutting it to one of a plurality of cut configurations, such that the size of the evaporative element is adaptable by varying said evaporative element between an uncut and one of the plurality of cut configurations. Preferably, the evaporative element 10C includes a plurality of stacked layers of cuttable, water retaining media 14C. The adhesive means bonds the layers together, forming a laminated evaporative element 10C. Prior to packaging, the guide 34C is attached to the evaporative element. The consumer obtains one of a plurality of cut configurations by cutting along the cutting guide 34C and the evaporative element 10C together to obtain the desired size.

The guide 34C is made of a suitable material and attached to the evaporative element 10C in a manner such that the evaporative element is cuttable with the guide remaining in place. Since the guide 34C will generally not be made of materials suitable for use as part of the evaporative element 10C, the method of attaching the guide 34C should also be consistent with easy removal of the guide after cutting, but just prior to installation of the evaporative element 10C in the humidifier. Preferably, an adhesive is used to attach the guide 34C to the evaporative element 10C with sufficient strength that it does not move during cutting, but that easily peals off after cutting is complete.

Most preferably, the guide 34C is a preprinted paper that is attached to the evaporative element 10C prior to packaging, so that, when received by the consumer, no action is required by the consumer in attaching the guide to the evaporative element. The guide includes cutting lines 36C that are indicative of a plurality of cut configurations and clearly direct the consumer how to trim the evaporative element to obtain the required size. Use of color-coded lines, pictures or icons 38C are optionally used to help the consumer choose and stay on the appropriate set of cutting lines 36C.

Choice of preferred materials for the water retaining media 14C and the rigid layer 16C is cuttable, for example, with scissors or a utility knife, in order to be suitable for use in this embodiment. Wicking paper is the most preferred water retaining media 14C, and aluminum foil remains the preferred material for use as the rigid layer 16C as they are easily cut to size. The preferred evaporative element 10C is constructed as described in the first embodiment.

Figure 6:
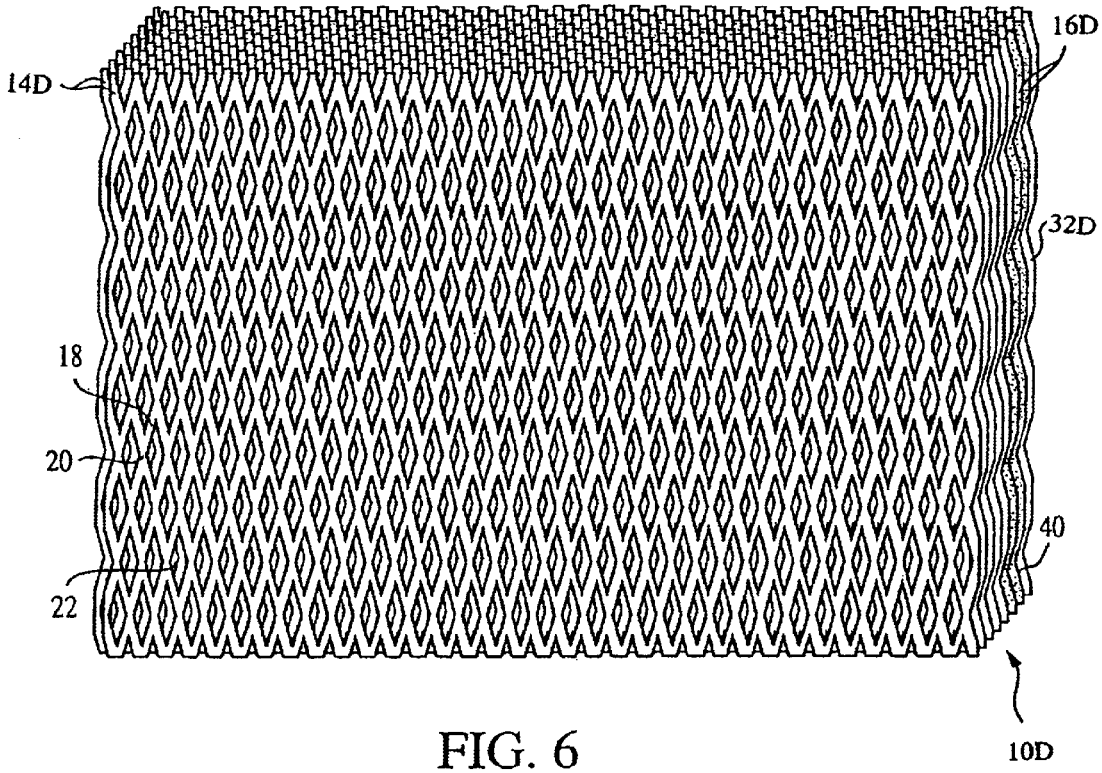
FIG. 6 is a perspective view of a fourth embodiment of the invention.

FIG. 6 shows a fourth embodiment of this invention, generally designated 10D, whereby the evaporative element is adaptable between layers rather than across layers. The separable portion 32D takes the form of separable layers, allowing the user to modify the thickness of the evaporative element 10D to fit multiple humidifiers. The evaporative element 10D includes stacked layers of the water retaining media 14D, divided into at least two portions. Each portion contains a plurality of layers 14D that are bonded to each other to form a laminated unit. The evaporative element 10D also includes at least two rigid layers 16D that are juxtaposed to each other and separably bonded together. At least one laminated unit of the water retaining media 14D is positioned on either side of the rigid layers 16D, sandwiching the rigid layers between the multiple layers of water retaining media.

When adapting this evaporative element 10D, each of the two adjacent rigid layers 16D is grasped and they are pulled apart, separating the evaporative element between the rigid layers of material and forming the adapted evaporative element and the separable layers 32D. Use of two or more rigid layers 16D provides strength to withstand the separation, as well as ensuring that there is a support layer on the evaporative element 10D after being adapted.

Preferably, the rigid material 16D is metal, plastic, stiff paper or cardboard, but can be any material that provides support to the water retaining media 14D and is strong enough to hold together during the process of pulling apart the layers during adaptation.

The relative amounts of water retaining media 14D on each side of the rigid material layers 16D determine the thickness of the adapted evaporative element 10D relative to the separable layers 32D. If the number of layers of water retaining media 14D in the laminated unit on each side are the same, identical adapted evaporative elements 10D are formed, each of which can be used in the humidifier. It is also contemplated that the separable element 32D is an appropriate thickness to be used in another model humidifier, or that the separable element is not a useful thickness and is discarded.

Preferably, two adhesives are used, a first adhesive to allow the layers to easily separate between the rigid material layers 16D, and a second adhesive to maintain strength between other water retaining layers 14D and between each rigid layer 16D and the adjacent water retaining layer 14D. The suitable first adhesive bond is strong enough to hold the evaporative element 10D together before separation, but separates without the use of tools when the rigid layers 16D are pulled apart.

If the optional filter media 24D is used in this embodiment, it is preferable that it be located on the outside of the evaporative element 10D, adjacent to the water retaining layers 14D. The water retaining layers 14D are therefore sandwiched between the filter media 24D and the rigid material layers 16D.

Figure 7:
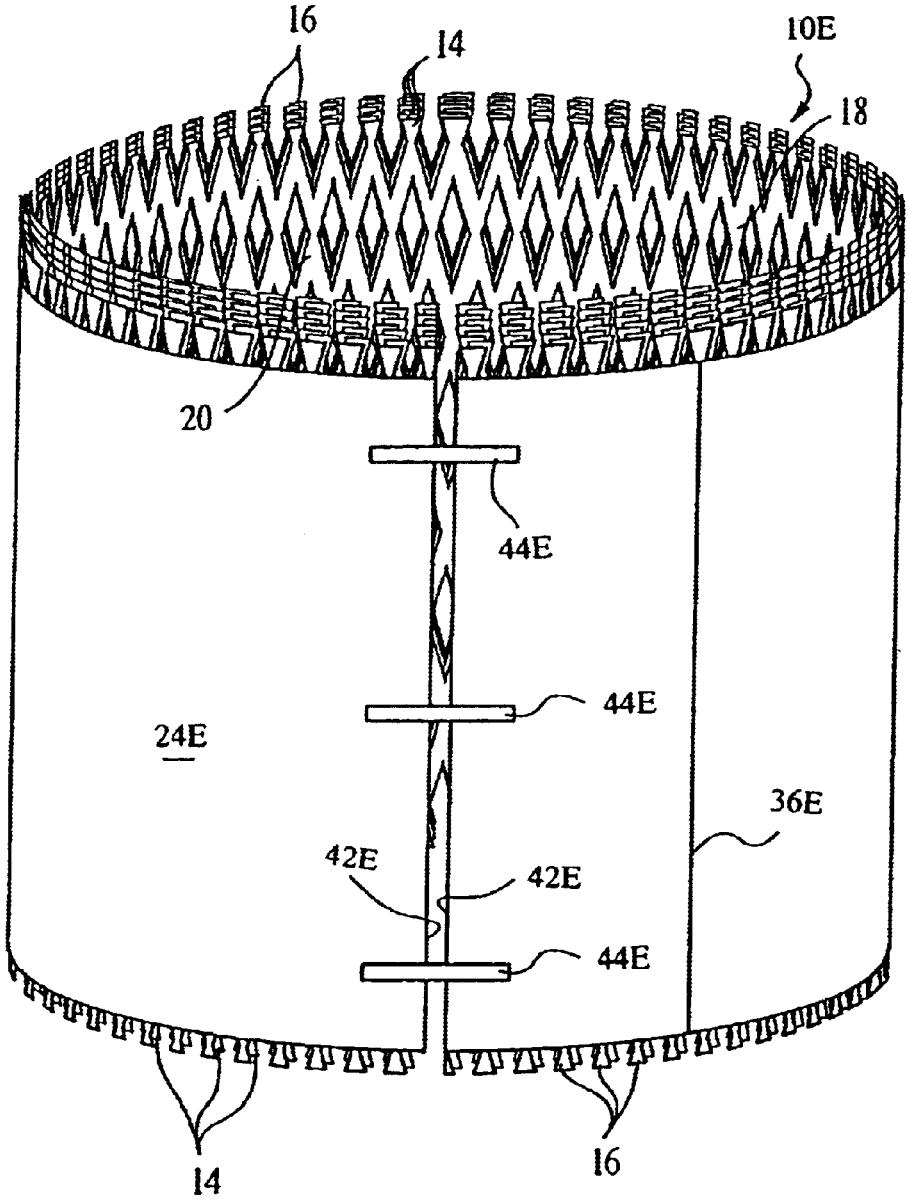
FIG. 7 is a perspective view of a fifth embodiment of the evaporative element.

In a fifth embodiment of this invention, shown in FIG. 7 and generally designated 10E, a cylindrical evaporative element is formed from a length of evaporative material equal to the circumference of the desired cylinder. Ends 42E of the evaporative material are abutted to each other and secured, forming the cylindrical shape.

The evaporative element 10E of this embodiment is adapted by cutting the length of the evaporative material to form a cylinder of the desired circumference. Optionally, there are one or more cutting lines 36E, on the evaporative material that are indicative of where the element should be cut to obtain an evaporative element 10E of the appropriate circumference for a particular humidifier. Where there are cutting lines 36E for multiple humidifiers, the use of color-coded lines, pictures, notations or icons are optionally used to help consumers select and stay on the appropriate cutting line. The cutting line 36E is suitably marked directly on the evaporative material or filter media 24E. Alternately, the evaporative element 10E optionally includes a removable paper guide (not shown) having one or more lines showing how to adapt the evaporative element.

After the evaporative element 10E has been adapted to an appropriate length, the ends 42E are brought together to form a cylinder and secured to each other. Preferably, one or more fasteners 44E are used to hold the ends 42E together.

These and other embodiments of this invention all utilize the water retaining media 14 to facilitate air-water contact. The water retaining media 14 includes any substance that is air permeable and will hold sufficient water to provide suitable evaporation. Water absorbent materials, such as paper or spongy fabrics are preferred, but non-absorbent materials may be used if sufficient water is held on the surface of the material to provide suitable contact between the air and water.

Wicking paper is the most preferred water retaining media 14 in this embodiment. The term "wicking paper" is intended herein to mean blotter type papers having superior capillary rise properties. Wicking paper has an exceptional ability to absorb water. It provides a constant supply of water at its surface due to capillary action. As the water evaporates and becomes airborne, the water at the surface of the media 14 is quickly replaced by water being sucked up through the pores of the paper. It also acts to easily distribute water that is distributed to the media 14. If a portion of the paper is immersed in water or in the water path of a trickle down type humidifier, capillary action will also tend to wick away a portion of the water to nearby pores that contain less water. In this embodiment, the resiliency of the paper media 14 tends to expand the media in the unfolded configuration because it tends to decompress itself. This improves the surface area and the ability of the media to hold water compared to the compressed state.

Applicant has discovered that Ahlstrom Filtration grade No. 939-39 paper made by Ahlstrom Filtration, Inc., Mt. Holly Springs, Pa. 17065, is an excellent wicking paper for fabrication of the evaporative element of the invention. The Ahlstrom paper is 97–100% cellulose fiber with a trace of polyamide wet strength resin. The paper has a basis weight of 37–41 lbs. Per ream (20 in.×20 in.×500 sheets). It has a thickness of 0.026 to 0.036 inches. Its wet burst is 150" $H_2O$ min. The Frazier permeability of the Ahlstrom paper is 30–40 cm/ft$^2$. Most importantly, the Ahlstrom grade No. 939-39 paper has a capillary rise ability of 79–112 mm/min. The excellent capillary rise ability of the paper greatly enhances the spreading of water throughout the evaporative element, which improves the evaporative rate.

Multiple layers of thin aluminum foil may be used as the water retaining media 14, if the surface is coated to prevent rapid runoff of the water. Such coatings are well known in the art, for example U.S. Pat. No. 2,955,064, herein incorporated by reference, and are generally based on ceramic or clay compositions. Any coating that provides sufficient water retention properties is suitable for use with this invention. Use of coated foil as the water retaining media 14 produces a longer lasting cartridge because the foil retains its shape longer and is less subject to deterioration than paper media.

The preferred malleable, substantially rigid material layer 16 is a metal. This rigid layer 16 is juxtaposed to at least one of the layers of water retaining media 14 and is suitably rigid to provide structural support to the media layers, and suitably malleable to hold the stacked media layers in either a prefolded or an unfolded configuration. Exact thickness of the rigid layer 16 must be determined by the shape and size of the evaporative element 10 that is formed and the number of rigid material layers 16 to be used, but generally, relatively thin materials, such as metal foils, are suitable in this application, and are preferred materials. The thickness of this layer 16 should be no greater than needed to be functional in order to minimize the cost of the evaporative element 10. Thickness of about 0.008 inches is preferable for many applications.

Aluminum foil is the most preferred rigid layer 16 because of its lightweight, malleability and corrosion resistance. The foil must be perforated in some manner to allow flow of air through the layer. Other suitable materials for use in the rigid layer 16 include plastics, cardboard or stiff papers. Where slit and expanded construction is used for the substantially rigid layer 16, it is preferred that the bridges 18 be oriented horizontally. In this position, there is a natural inclination for the bridge 18 to catch and divert cascading water.

Where the water retaining media 14 is sufficiently rigid to provide its own structural support, the rigid layer 16 and the water retaining material 14 are optionally the same substance. This occurs, for example, where coated aluminum foil is used as the water retaining media 14. When this occurs, both functions are considered to be performed by a single substance. The rigid material layer 16 is also optionally coated to provide additional water retention.

An adhesive is used for bonding the layers of media together and for bonding the rigid material layer to the water retaining media layers to form a laminated evaporative element. Any adhesive may be used that does not overly hinder the evaporation function by sealing too much of the water retaining surface 14. Hot melt adhesive has been found to be suitable when used to coat only the edges of the adjoining surfaces. Where slit and expanded construction is used, the edges of the bridges 18 and strings 20 are coated, thereby forming a bond with the bridge or string of the adjacent layer.

It is preferable that a single adhesive be used to bond all of the layers to each other, however, the use of two or more adhesives is contemplated and considered to be within the scope of this invention. The choice of the water retaining media 14 and the rigid layer 16 may require that one adhesive be required for bonding the water retaining media layers 14 together, and a different adhesive needed to bond the rigid layer 16 to the water retaining media 14 to form a stack. A third adhesive is optionally used to bond multiple stacks or to attach optional components, such as a filter media 24E, shown in FIG. 7.

The optional filter media 24E comprises a layer of material that provides air-filtering capacity. The filter media 24E comprises a water-insoluble, porous material, such as a synthetic media. Preferred filter media 24E include polymers or co-polymers, spun polymers, foams, twisted, non-woven and micorporous webs. The synthetic media is preferably made from one or more fibers such as acrylic, nylon, rayon, vinyl, polyolefin, polyester, polyethylene or polypropylene fibers. The exact thickness of the filter media 24E depends upon the material used, its porosity and the desired degree of filtration, however, a preferred thickness is in the range of from about 0.01 inches to about 1 inch. It is also preferred that the filter media 24E be cuttable for use in embodiments where the evaporative element is cut to a specific size.

The filter media 24E should be positioned so that it is upstream of the evaporative element. If the filter media 24E is downstream of the evaporative element 10E, the water vapor that entered the air may redeposit on the filter media instead of remaining airborne to humidify the living area. In addition, the presence of particulates in the air to be humidified may provide nuclei for condensation of the water vapor, causing it to condense and little on surfaces shortly after exiting the evaporative element 10E. Humidification efficacy is maximized where particulates are filtered before the aid contacts the evaporative element 10E. Thus, the filter media 24E is preferably placed on the exterior, that is, on the side of the evaporative element 10E closest to where room air is brought into contact with the evaporative element.

It is also preferred that the filter media 24E be treated with an anti-microbial agent to resist growth of mold, mildew, fungus, and bacteria. The anti-bacterial agent may be applied by any method known in the art, such as by treatment of the fibers prior to formation of the synthetic media or by dipping of the synthetic media.

The preferred fastener 44E is part of a hook and loop type fastener, such as those sold under the VELCRO® name, however, any fasteners that adhere to the evaporative element in any way are useful. Additional examples of suitable fasteners 44E include clamps, clips and reusable adhesives, including tapes, or a rigid structure comprising a bar with a protrusion at each end, resembling a large staple.

The use of the optional filter media 24 that is attachable to the hook portion of hook and loop fasteners is particularly useful in this embodiment of the invention. Most preferably, the fastener 44 is the hook portion of the hook and loop fastener system. The material selected as the air filter media 24 advantageously functions as a loop portion of the hook and loop fastener system. When the entire air filter media 24 receives the hooked fastener 44, the fastener is removably placeable anywhere on the filter media. Placement of the loop portion 46 need not be predetermined. Regardless of where the evaporative element 10E is cut in adapting its diameter, the fastener 44E is useful to hold the ends 42 together, forming the cylinder. Non-woven, synthetic fabrics, such as spun polypropylene or spun polyester are useful air filter media 24 that also act as the loop portion of hook and loop systems.

It is also contemplated that this invention could be used to make additional embodiments of this invention by applying the principle of the invention multiple times. For example, an evaporative element using the features of the first embodiment is foreseen to fit multiple humidifier models by application of multiple folds. Multiple slits are optionally used in another embodiment, however, care must be taken that the slits are not too close together. If a separable portion is made too small, application of force could result in breakage along a slit that was not intended, or, it may break along portions of two slits and across a separable portion. Multiple slits should be used only where there is sufficient space between the slits that a force applied to one slit will not cause rupture along an unintended slit. In embodiments that utilize cutting lines, multiple lines could be used to denote several possible size adaptations, marked directly on the evaporative element or on the cutting guide. The thickness of an evaporative element could be adapted by removing a number of separable layers, then modifying the length or width of the evaporative material by cutting or folding.

While particular embodiments of the adaptable evaporative element for a humidifier have been shown and described, it will be appreciated by those skilled in the art that changes and modifications may be made thereto without departing from the invention in its broader aspects and as set forth in the following claims.

What is claimed is:

1. An adaptable, cylindrical evaporative element for a humidifier, comprising:

a cylinder formed from a circumferential length of flexible, cuttable, laminated evaporative media with ends abutted to each other, the diameter of said cylinder being adaptable by selecting said circumferential length between a cut and an uncut configuration; and at least one fastener removably attachable to said evaporative media to secure said ends in the abutted position.

2. The adaptable evaporative element of claim 1 further comprising at least one cutting line.

3. The evaporative element of claim 1 comprising at least two fasteners.

4. The evaporative element of claim 1 wherein said evaporation media comprises slit and expanded wicking paper.

5. The evaporative element of claim 1, wherein said cylinder has an air filter media attached to the exterior thereof and wherein said fastener is removably attachable to said air filter media.

6. The evaporative element of claim 5 wherein said fastener is a hook fastener and said air filter media is a loop fastener.

7. The evaporative element of claim 5 wherein said air filter media comprises a synthetic, non-woven media.

8. The evaporative element of claim 5 further comprising an adhesive for attaching said evaporative media to said filter media.

9. The evaporative element of claim 5 wherein said filter media further comprises an anti-microbial agent.

10. A method of adapting a cylindrical evaporative element, comprising:

providing a length of flexible evaporative media having ends;

determining the required circumferential length to fit a selected humidifier;

adapting the length of the evaporative media to the required circumferential length;

abutting the ends of the evaporative media to form a cylinder, and securing the ends to maintain the cylindrical shape.

11. The method of claim 10 wherein said adapting step comprises cutting the evaporative media.

* * * * *